United States Patent [19]

Musumiya et al.

[11] Patent Number: 4,819,500

[45] Date of Patent: Apr. 11, 1989

[54] PEDAL BRACKET ASSEMBLY AND METHOD OF INSTALLING SAME ON STRUCTURAL BODY

[75] Inventors: Raita Musumiya; Masaaki Minakawa, both of Saitama, Japan

[73] Assignee: Honda Giken Kogyo Kabushiki Kaisha, Tokyo, Japan

[21] Appl. No.: 21,696

[22] Filed: Mar. 4, 1987

[30] Foreign Application Priority Data

Mar. 4, 1986 [JP] Japan ..... 61-30865[U]

[51] Int. Cl.[4] ..... G05G 1/14

[52] U.S. Cl. ..... 74/513; 74/512; 74/560

[58] Field of Search ..... 74/512, 513, 514, 560, 74/561, 562, 563, 564

[56] References Cited

U.S. PATENT DOCUMENTS

| | | | |
|---|---|---|---|
| 2,823,557 | 2/1958 | Lenning | 74/512 |
| 2,936,867 | 5/1960 | Perry | 74/513 |
| 3,236,120 | 2/1966 | Fender | 74/512 |
| 3,236,121 | 2/1966 | Gdowik et al. | 74/512 |
| 3,237,479 | 3/1966 | Peterson | 74/560 |
| 3,498,156 | 3/1970 | McAllister et al. | 74/513 |
| 3,765,264 | 10/1973 | Bruhn | 74/512 |
| 3,975,972 | 8/1976 | Muhleck | 74/512 |
| 4,429,589 | 2/1984 | Stocker | 74/513 |

FOREIGN PATENT DOCUMENTS

| | | | |
|---|---|---|---|
| 0042146 | 3/1985 | Japan | 74/512 |
| 60-135329 | 7/1985 | Japan . | |

*Primary Examiner*—Gary L. Smith
*Assistant Examiner*—Vinh Luong
*Attorney, Agent, or Firm*—Irving M. Weiner; Joseph P. Carrier; Pamela S. Burt

[57] ABSTRACT

A pedal bracket assembly for installation on a structural body having a vertical member and a transverse member projecting transversely from the vertical member includes a support member having vertical flanges adapted to be fastened to the vertical member and side walls joined to the vertical flanges and extending vertically, a pedal pivotally coupled to the side walls, and a holder member having a first adjustable component connectable to the transverse member with first bolts and first nuts for positional adjustment in a first direction in which the transverse member projects, and second adjustable components connectable to the side walls with second bolts and second nuts for positional adjustment in a second direction normal to the transverse member.

6 Claims, 3 Drawing Sheets

PEDAL BRACKET ASSEMBLY AND METHOD OF INSTALLING SAME ON STRUCTURAL BODY

BACKGROUND OF THE INVENTION

1. Field of the Invention

The present invention relates to a pedal bracket assembly for use in a motor vehicle and a method of installing such a pedal bracket assembly on a structural body. More particularly, the present invention relates to a pedal bracket assembly which is robust enough to accurately bear both a large operating load and a delicate or small operating load applied by the motor vehicle driver and a method of installing such a pedal bracket assembly on a structural body.

2. Description of the Relevant Art

Pedals such as clutch and brake pedals in motor vehicles are foot-operated and normally subject to large operating foot loads.

Japanese Laid-Open Patent Publication No. 60 (1985)-135329, for example, discloses a structure by which such a pedal for bearing large loads is supported on a vehicle body. In the disclosed structure, a pedal bracket having two parallel side walls is fixed to a panel, or a horizontal member of a panel, which separates an engine compartment from a passenger's compartment and which constitutes a structural body of the vehicle. The side walls of the pedal bracket support a transverse pin extending therebetween. The pedal is supported on the lower end of an arm, while the upper end of the arm is angularly movably mounted on the transverse pin.

A structural body of a vehicle includes vertical and transverse members and is generally formed by either bending a single metallic sheet through a certain angle to provide such vertical and transverse members, or producing separate members and integrally welding or otherwise joining them as vertical and transverse members. The structural body is, therefore, prone to errors arising from the bending process when the metallic sheet is bent into the vertical and transverse members, or from dimensional errors of the separate members and the welding process when the separate members are integrally joined. The pedal is coupled to the push rod of a master cylinder disposed in the engine compartment on one side of the vertical member remotely from the pedal. The push rod extends through the vertical member and is pivotally coupled to an intermediate front edge of the pedal arm. Where the pedal bracket is mounted on an erroneously formed structural body, as described above, the pedal which is angularly mounted on the bracket is significantly affected by the errors of the structural body in that the push rod extending from the master cylinder and the pedal arm are highly likely to be displaced out of mutual alignment.

Conventionally, to allow the pedal arm to be held in accurate alignment with the push rod for proper connection with each other, the vertical and transverse members of the structural body must be bent or separately formed highly accurately, and must be installed in place with high accuracy. However, such high accuracy is undesirably expensive to achieve, often prohibitively so.

The pedals mounted on vehicle structural bodies are, therefore, normally displaced from desired positions on account of dimensional variations of the structural bodies. In the art, there is demand for a rugged pedal bracket structure, assembly, or mechanism which has a required degree of accuracy and is capable of accurately bearing both a large operating load and a delicate or small operating load applied by the motor vehicle driver, irrespective of the accuracy of a structural body on which the pedal bracket assembly is mounted.

SUMMARY OF THE INVENTION

In view of the foregoing problems of the conventional pedal bracket device, it is an object of the present invention to provide a rugged pedal bracket assembly which permits a pedal arm to be positioned highly accurately in alignment with the operating member of a pedal-operated actuator when the pedal bracket assembly is mounted on a structural body composed of vertical and transverse members, irrespective of errors produced when the vertical and transverse members are formed by bending, or dimensional errors of the vertical and transverse members as they are separately formed and subsequently joined, or errors caused when the structural body is mounted in position.

According to the present invention, there is provided a pedal bracket assembly for installation on a structural body having a vertical member and a transverse member projecting transversely from the vertical member. The pedal bracket assembly includes a support member having vertical flanges adapted to be fastened to the vertical member and side walls joined to the vertical flanges and extending vertically, a pedal pivotally coupled to the side walls, and a holder member having first adjustable means connectable to the transverse member with first bolts and first nuts for positional adjustment in a first direction in which the transverse member projects, and second adjustable means connectable to the side walls with second bolts and second nuts for positional adjustment in a second direction normal to the transverse member.

The first adjustable means comprises a plate-like main member having first oblong holes for insertion of the first bolts respectively therethrough, the first oblong holes being positioned for substantial registration with first circular holes defined in the transverse member, and the first oblong holes being elongate in the first direction.

The second adjustable means comprises plate-like legs having second oblong holes for insertion of the second bolts respectively therethrough, the second oblong holes being positioned for substantial registration with second circular holes defined in the side walls, and the second oblong holes being elongate in a direction normal to the main member.

The pedal bracket assembly can be installed on the structural member by fastening the flanges of the support member to the vertical member, aligning the second oblong holes with the second circular holes, inserting the second bolts through the second oblong holes and the second circular holes, adjustably threading the second nuts over the second bolts, aligning the first oblong holes with the first circular holes, inserting the first bolts through the first oblong holes and the first circular holes, adjustably threading the first nuts over the first bolts, and thereafter, tightening the second bolts and nuts together and the first bolts and nuts together.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
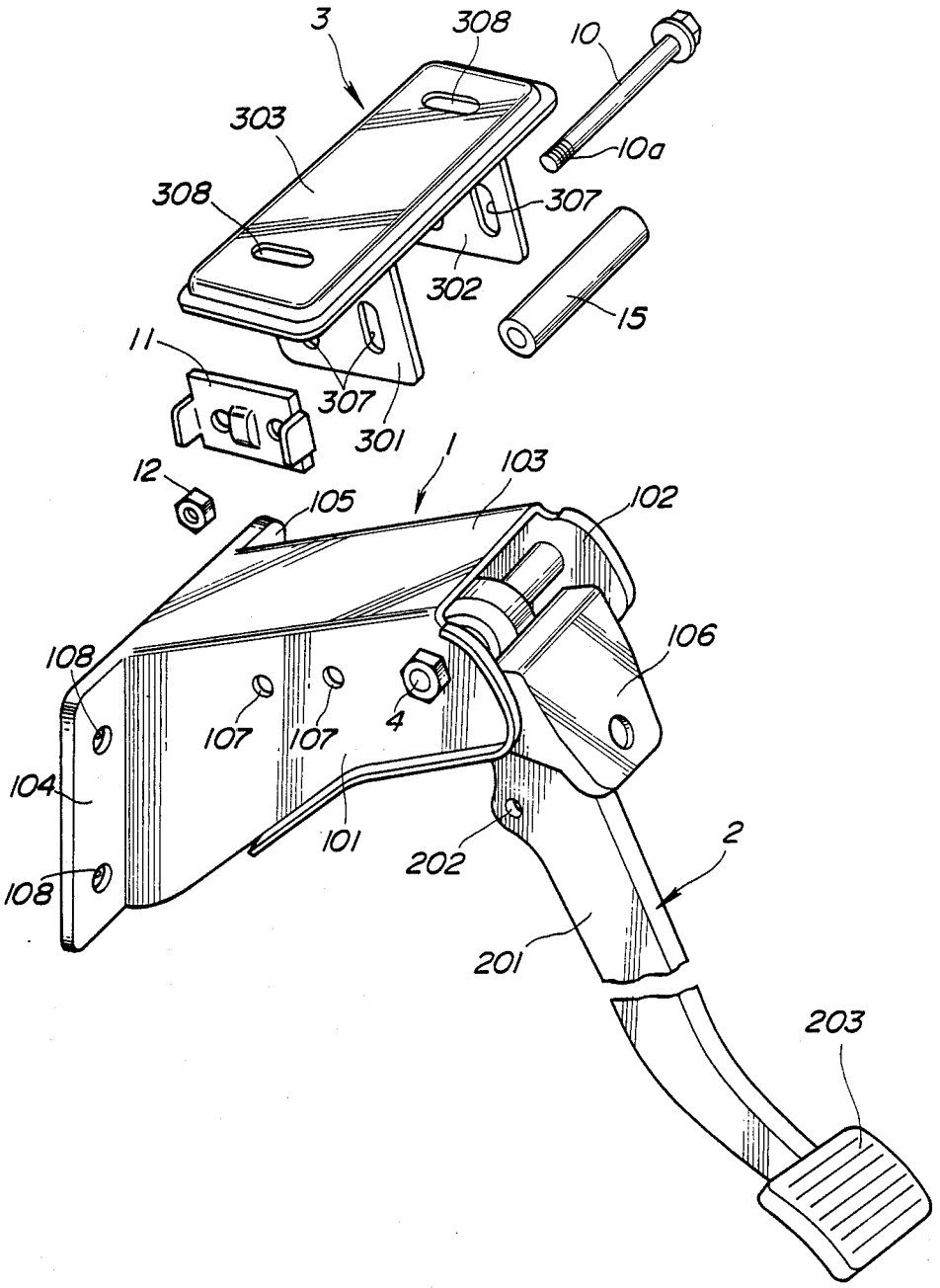
FIG. 1 is an exploded perspective view of a pedal bracket assembly according to the present invention.

As shown in FIG. 1, a pedal bracket assembly according to the present invention primarily includes a support member 1, a holder member 3 for reinforcing the support member 1, and a pedal 2 pivotally supported on the support member 1.

The support member 1 is of an inverted U-shaped cross section having two laterally spaced parallel side walls 101, 102 and an upper wall 103 interconnecting the upper edges of the side walls 101, 102. The support member 1 also includes two laterally spaced parallel attachment flanges 104, 105 joined respectively to the front edges of the side walls 101, 103, the attachment flanges 104, 105 being bent outwardly away from each other. A switch holder 106 is disposed between the rear ends of the side walls 101, 102. The pedal 2 includes an arm 201 with its upper end pivotally mounted on a shaft 4 transversely extending between and supported on the rear ends of the side walls 101, 102. The shaft 4 is secured to the side walls 101, 102 by means of nuts threaded over the opposite ends of the shaft 4. The arm 201 has a hole 202 defined in an intermediate front edge thereof for attachment to the front end of a push rod (not shown) of an actuator such as a master cylinder. The pedal 2 also includes a tread member 203 attached to the lower end of the arm 201.

Each of the side walls 101, 102 has two longitudinally spaced circular attachment holes 107 defined in a longitudinally intermediate, upper portion thereof. Each of the attachment flanges 104, 105 has two vertically spaced circular atttachment holes 108.

The support member 1 is secured to a vertical member of a vehicle structural body (not shown in FIG. 1). The holder member 3 is attached to and depends from a transverse member of the vehicle structural body, and is also fastened to the support member 1. The support member 1 as it is mounted on the vertical member is therefore stiffened by the holder member 3 affixed to the transverse member, so that the pedal bracket assembly as a whole is of a rugged or robust construction.

The holder member 3 comprises a main member 303 positioned transversely over the upper wall 103 of the support member 1, and two laterally spaced legs 301, 302 depending from the lower surface of the main member 303. The distance between the legs 301, 302 is selected such that the inner surfaces of the legs 301, 302 are held against the outer surfaces of the side walls 101, 102, respectively, in overlapping relation. Each of the legs 301, 302 has a pair of vertically oblong holes 307 spaced from each other in the longitudinal direction of the support member 1. With the holder member 3 mounted on the support member 1, the oblong holes 307 of each of the legs 301, 302 are held in registration with the attachment holes 107 of the corresponding one of the side walls 101, 102. The main member 303 has two oppositely directed overhanging portions extending beyond the legs 301, 302 and having respective oblong holes 308 which are elongate in the longitudinal direction of the support member 1.

Figure 2:
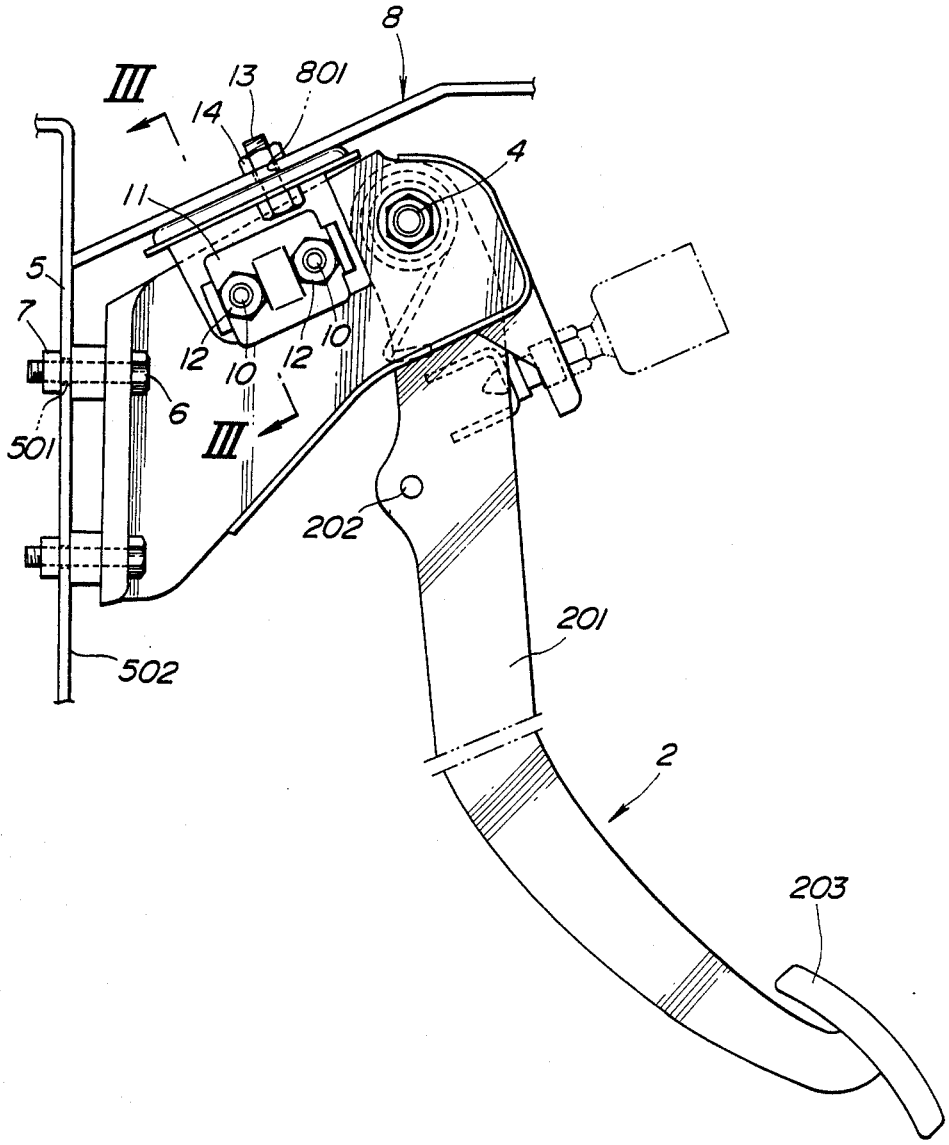
FIG. 2 is a side elevational view of the pedal bracket assembly as it is installed on a motor vehicle body.

The support member 1 and the holder member 3 are attached to vertical and transverse members, of a structural body respectively, as follows:

FIG. 2 shows the pedal bracket assembly of the invention as it is installed on the structural body comprising a vertical member 5 and a transverse member 8. The transverse member 8 is shown as projecting from the vertical member 5 into the passenger's compartment at an angle greater than 90° with respect to the vertical member 5.

The vertical member 5 has attachment holes 501 for attaching the support member 1 which are positioned with reference to the master cylinder in the engine compartment.

For mounting the pedal bracket assembly of the invention on the structural body, the support member 1 with the pedal 2 and the switch holder 106 combined therewith is fastened to the vertical member 5.

More specifically, the attachment flanges 104, 105 are held against the surface 502 of the vertical member 5 which faces the passenger's compartment, with collars therebetween, and affixed thereto by means of bolts 6 extending through the attachment holes 108, 501 and nuts 7 tightened on the bolts 6. The attachment hole 202 of the arm 201 for connection to the push rod of the master cylinder is now positioned with respect to the vertical member 5. The attachment hole 202 is positioned highly accurately by flat face-to-face engagement between the flanges 104, 105 and the attachment surface 502 of the vertical member 5.

Figure 3:
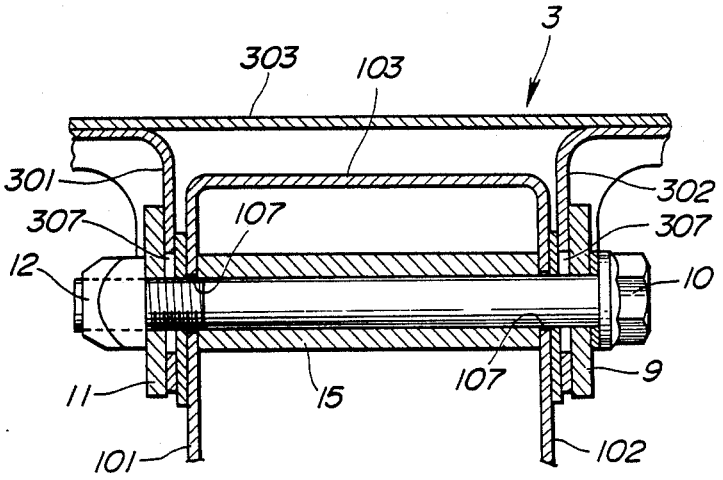
FIG. 3 is a cross-sectional view taken along line III—III of FIG. 2.

Then, the holder member 3 for stiffening the support member 1 is attached to the transverse member 8 in the following manner: First, the main member 303 and the legs 301, 302 of the holder member 3 are placed on the upper wall 103 and the side walls 101, 102, respectively, of the support member 1 fastened to the vertical member 5, across an intermediate portion of the support member 1. The oblong holes 307 of the holder member 3 are brought into registration with the circular holes 107 of the support member 1. Spacers are placed between the legs 301, 302 and the side walls 101, 102. With a collar 9 (FIG. 3) held against the outer surface of one of the legs, for example, 302, bolts 10 with externally threaded ends 10a are passed through the holes 307 of the leg 302 and the holes 107 of the side walls 102, with washers between the bolt heads and the collar 9. Then, elongate collars 15 are disposed between the legs 301, 302 over the bolts 10. The threaded ends **10*a* of the bolts 10 are inserted through the holes 107 of the side wall 101 and the holes 307 of the leg 301. With another collar 11 held against the outer surface of the leg 301, nuts 12 are adjustably threaded over the threaded ends 10*a* of the bolts 10 which project from the collar 11**.

Thereafter, the holder member 3 is installed on the transverse member 8 which has circular attachment holes 801 (FIG. 2) defined for registration with the oblong holes 308 of the holder member 3.

More specifically, the oblong holes 308 of the main member 303 are brought into registration with the holes 801 of the transverse member 8, and bolts 13 are passed through the holes 308, 801, following by tightening nuts 14 over the bolts 13. Since the holes 308 of the main member 303 are oblong in shape, they can absorb a certain positional displacement between the holes 308, 801 in the longitudinal direction of the support member 1. Then, the nuts 12 are firmly tightened on the bolts 10, respectively, to join the support member 1 and the holder member 3 completely to each other. Inasmuch as the holder member 3 can be positionally adjusted with respect to the support member 1 and the transverse member 8 through the oblong holes 307, 308, respectively, certain vertical and horizontal positional displacement of the holder member 3 which may result from an error produced when forming the transverse member 8 or an error produced when attaching the transverse member 8 to the vertical member 5 can be aborbed by moving the holder member 3 along the oblong holes 307, 308.

The support member 1 with the holder member 3 thus adjustably installed thereon is not subject to any upward or downward load which would otherwise be generated if the holder member 3 were conventionally, or not adjustably, attached to the transverse member 8. The support member 1 is therefore prevented from being vertically twisted under such undesired load. The pedal bracket assembly thus allows the attachment hole 202 to be accurately positioned in alignment with the push rod of the master cylinder or actuator. The pedal bracket assembly thus installed on the vehicle structural body is of a rugged construction capable of accurately bearing both large and small operating loads imposed by the operator's foot on the tread member 203 of the pedal 2.

While the holes 307 of the holder member 3 for attachment to the support member 1 are shown as being elongate in the above embodiment, the holes 107 of the support member 1 may instead be elongate in shape. The transverse member 8 projecting from the vertical member 5 into the passenger's compartment may lie at a suitable angle, other than the illustrated angle, with respect to the vertical member 5, and the support member 1 and the holder member 3 may be shaped to meet the selected angle.

Although there has been described what is at present considered to be the preferred embodiment of the present invention, it will be understood that the invention may be embodied in other specific forms without departing from the spirit or essential characteristics thereof. The present embodiment is therefore to be considered in all aspects as illustrative, and not restrictive. The scope of the invention is indicated by the appended claims rather than by the foregoing description.

We claim:

1. A pedal bracket assembly for installation on a structural body having a vertical member and a transverse member projecting transversely from the vertical member, the pedal bracket assembly comprising:

a support member having vertical flanges adapted to be fastened to the vertical member of the structural body and side walls joined to said vertical flanges and extending vertically;

a pedal pivotally coupled to said side walls; and a holder member having first adjustable means adapted to be connected to the transverse member of the structural body with first bolts and first nuts for positional adjustment in a first direction in which the transverse member projects, and second adjustable means adapted to be connected to said side walls with second bolts and second nuts for positional adjustment in a second direction normal to the transverse member.

2. A pedal bracket assembly according to claim 1, wherein said first adjustable means comprises a plate-like main member having first oblong holes for insertion of said first bolts respectively therethrough, said first oblong holes being positioned for substantial registration with first circular holes defined in the transverse member, said first oblong holes being elongate in said first direction.

3. A pedal bracket assembly according to claim 2, wherein said second adjustable means comprises plate-like legs having second oblong holes for insertion of said second bolts respectively therethrough, said second oblong holes being positioned for substantial registration with second circular holes defined in said side walls, said second oblong holes being elongate in a direction normal to said main member.

4. A structural body and a pedal bracket assembly for installation on the structural body, comprising:

a structural body having a vertical member and a transverse member projecting transversely from the vertical member;

a support member having vertical flanges adapted to be fastened to the vertical member of the structural body and side walls joined to said vertical flanges and extending vertically;

a pedal pivotally coupled to said side walls; and a holder member having first adjustable means adapted to be connected to the transverse member of the structural body with first bolts and first nuts for positional adjustment in a first direction in which the transverse member projects, and a second adjustable means adapted to be connected to said side walls with second bolts and second nuts for positional adjustment in a second direction normal to the transverse member.

5. Apparatus according to claim 4, wherein said first adjustable means comprises a plate-like main member having first oblong holes for insertion of said first bolts respectively therethrough, said first oblong holes being positioned for substantial registration with first circular holes defined in the transverse member, said first oblong holes being elongate in said first direction.

6. Apparatus according to claim 5, wherein said second adjustable means comprises plate-like legs having second oblong holes for insertion of said second bolts respectively therethrough, said second oblong holes being positioned for substantial registration with second circular holes defined in said side walls, said second oblong holes being elongate in a direction normal to said main member.

* * * * *

UNITED STATES PATENT AND TRADEMARK OFFICE

CERTIFICATE OF CORRECTION

PATENT NO. : 4,819,500

DATED : April 11, 1989

INVENTOR(S) : Raita Musumiya and Masaaki Minakawa

It is certified that error appears in the above-identified patent and that said Letters Patent is hereby corrected as shown below:

Column 1, line 66, before "demand" add --a--.

Column 4, line 63, change "following" to --followed--.

Column 5, line 6 and 7, change "displacement" to --displacements--.

Column 5, line 11, change "aborbed" to --absorbed--.

Signed and Sealed this

Tenth Day of October, 1989

*Attest:*

DONALD J. QUIGG

*Attesting Officer*

*Commissioner of Patents and Trademarks*